US005222269A

United States Patent [19]

Walker

[11] Patent Number: 5,222,269

[45] Date of Patent: Jun. 29, 1993

[54] PROPANE TANK CLEANING MACHINE

[76] Inventor: Reid W. Walker, Rte. 2, Box 170, Ranburne, Ala. 36273

[21] Appl. No.: 921,149

[22] Filed: Jul. 29, 1992

[51] Int. Cl.[5] ..... A46B 13/04

[52] U.S. Cl. ..... 15/56; 15/70

[58] Field of Search ..... 15/56-58, 15/65, 70, 88, 104.04; 134/6

[56] References Cited

U.S. PATENT DOCUMENTS

| | | | |
|---|---|---|---|
| 2,628,378 | 2/1953 | Gilbert et al. | 15/58 |
| 2,685,096 | 8/1954 | Kaye | 15/56 |
| 2,889,566 | 6/1959 | Parks | 15/58 |
| 3,680,165 | 8/1972 | Garst et al. | 15/56 |
| 4,125,087 | 11/1978 | Ronning | 15/56 |

*Primary Examiner*—Edward L. Roberts
*Attorney, Agent, or Firm*—Diller, Ramik & Wight

[57] ABSTRACT

A mac provided for cleaning a propane tank or the like during rotation of the same about its axis while being rotated upon a carriage when the carriage is reciprocated into and out of a cleaning chamber, the cleaning is achieved by two brushes which clean an end of the tank and a peripheral wall thereof by rotating about generally parallel horizontal axes, the brushes are driven from a single reversible electric motor, and appropriate drive connections are provided from the motor to reciprocate the carriage and rotate rollers which rotate the tank during the cleaning thereof.

29 Claims, 5 Drawing Sheets

PROPANE TANK CLEANING MACHINE

BACKGROUND OF THE INVENTION

This invention relates to a machine for cleaning propane tanks, and while specifically designed therefor, the machine is capable of cleaning other objects of similar size and contour, or dimensions of the machine can be changed for cleaning smaller or larger articles, such as barrels, drums; acetylene, oxygen, argon or similar gas bottles, or the like.

DESCRIPTION OF RELATED ART

U.S. Pat. No. 2,628,378 in the name of Gilbert et al. issued on Feb. 17, 1953 discloses a drum cleaning machine which includes brushes 10, 11 for cleaning the periphery of a drum and a feed roller 12 for feeding the drum and rotating the drum in cooperative interaction with upper and lower brushes. Brushes 71 and 72 are also provided for cleaning ends of the drum.

U.S. Pat. No. 2,685,096 in the name of Kaye issued on Aug. 3, 1954 discloses a cleaning apparatus for cleaning gas cylinders which includes a rotary body brush 19 driven by a motor 21 through appropriate gearing (See FIG. 2) and a cup-shaped brush 29 for cleaning recessed bottoms of the gas cylinders.

U.S. Pat. No. 3,680,165 in the name of Garst et al. issued on Aug. 1, 1972 discloses another tank cleaning apparatus in which a vertically upright tank 25 is rotated about its axis and is cleaned by a rotary brush 24 which is moved vertically during the cleaning operation.

U.S. Pat. No. 4,125,087 in the name of Rönning issued on Nov. 14, 1978 discloses another apparatus for cleaning gas bottles in a vertical position, and in this case the gas bottle is rotated while two brushes 36, 36 are moved vertically.

U.S. Pat. No. 2,597,946 in the name of Olson issued on May 27, 1952 discloses an apparatus for feeding can bodies between rollers 17 and a rotating brush 16 during which time the can bodies are rotated and exterior surfaces thereof are cleaned by the brushes 16.

U.S. Pat. No. 247,478 in the name of Everhard issued on Sep. 27, 1881 discloses a machine for painting barrel heads in which axially aligned brushes FF' are rotated to paint opposite heads of a barrel located within the machine.

SUMMARY OF THE INVENTION

The present invention is directed to a novel machine for cleaning an object during the rotation thereof about its axis with the machine being so constructed and arranged that a peripheral surface of the object and an axial end of the object are cleaned by rotating brushes during the advancement of the object into a chamber of the machine and its removal therefrom.

In accordance with the present invention, the overall cleaning machine is of a relatively simple construction having a minimum number of parts which collectively are operated from a single drive motor which, through cooperative drive mechanisms, feeds the object into and out of the machine, rotates a brush for cleaning an exterior peripheral surface of the object during movement of the object in opposite directions into and out of the machine, and also rotates another brush in opposite directions for cleaning an end of the object during respective feed of the object into and out of the machine.

In further accordance with the present invention, the motor is a reversible motor which is also drivingly connected to a feed screw which is in turn connected to a threaded connection of a carriage supporting the object which is to be cleaned, and the latter construction allows the screw to be rotated in opposite directions upon reversal of the motor to achieve reciprocal movement of the carriage and the associated object into and out of a cleaning chamber of the machine.

The present invention also provides a novel mounting for the brush utilized for cleaning the periphery/peripheral surface of the object by rotatably mounting the brush upon a manually operable handle which is selectively pivoted as desired to move the brush along an arcuate path into or out of contact with a periphery of the object and vary the pressure of the brush thereagainst.

In further accordance with the invention, the carriage which houses the object to be cleaned is provided with adjusting end plates to vary the axial length of the carriage to accommodate objects of different axial lengths, and the carriage also includes a pair of driven rollers which are rotated to rotate the object during the cleaning thereof.

With the above and other objects in view that will hereinafter appear, the nature of the invention will be more clearly understood by reference to the following detailed description, the appended claims and the several views illustrated in the accompanying drawings.

DESCRIPTION OF THE PREFERRED EMBODIMENT

Figure 1:
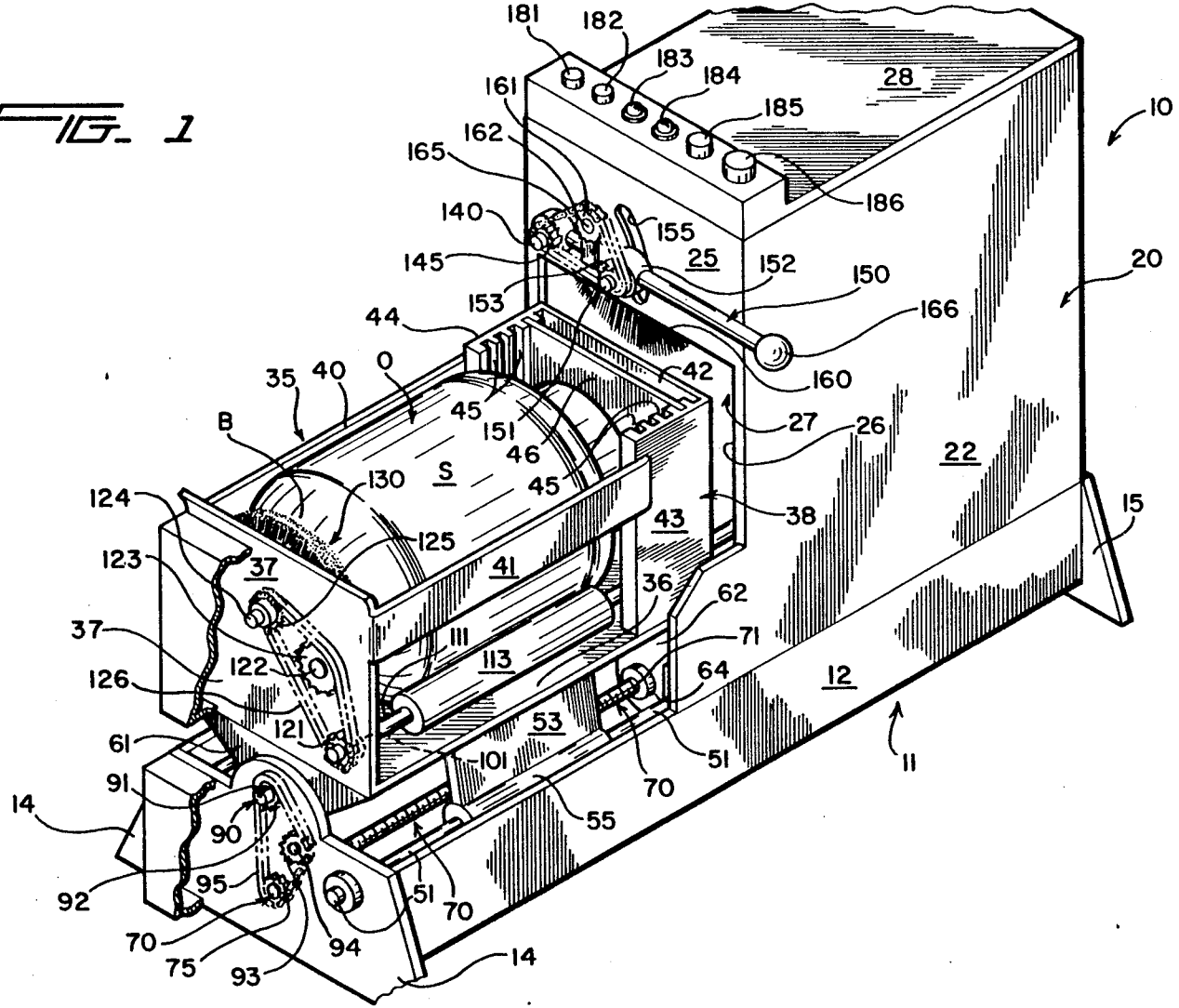
FIG. 1 is a perspective view of a novel cleaning machine for cleaning generally cylindrical shaped objects, such as gas or propane tanks, and illustrates a frame, a housing defining a cleaning chamber, a carriage supporting a tank upon its horizontal axis for movement into and out of the chamber, and brushes for cleaning both a outer periphery/cylindrical surface and an end or bottom wall or surface of the object.

A novel machine for cleaning objects during the rotation thereof about a longitudinal axis of such an object is generally designated by the reference numeral 10.

Figure 2:
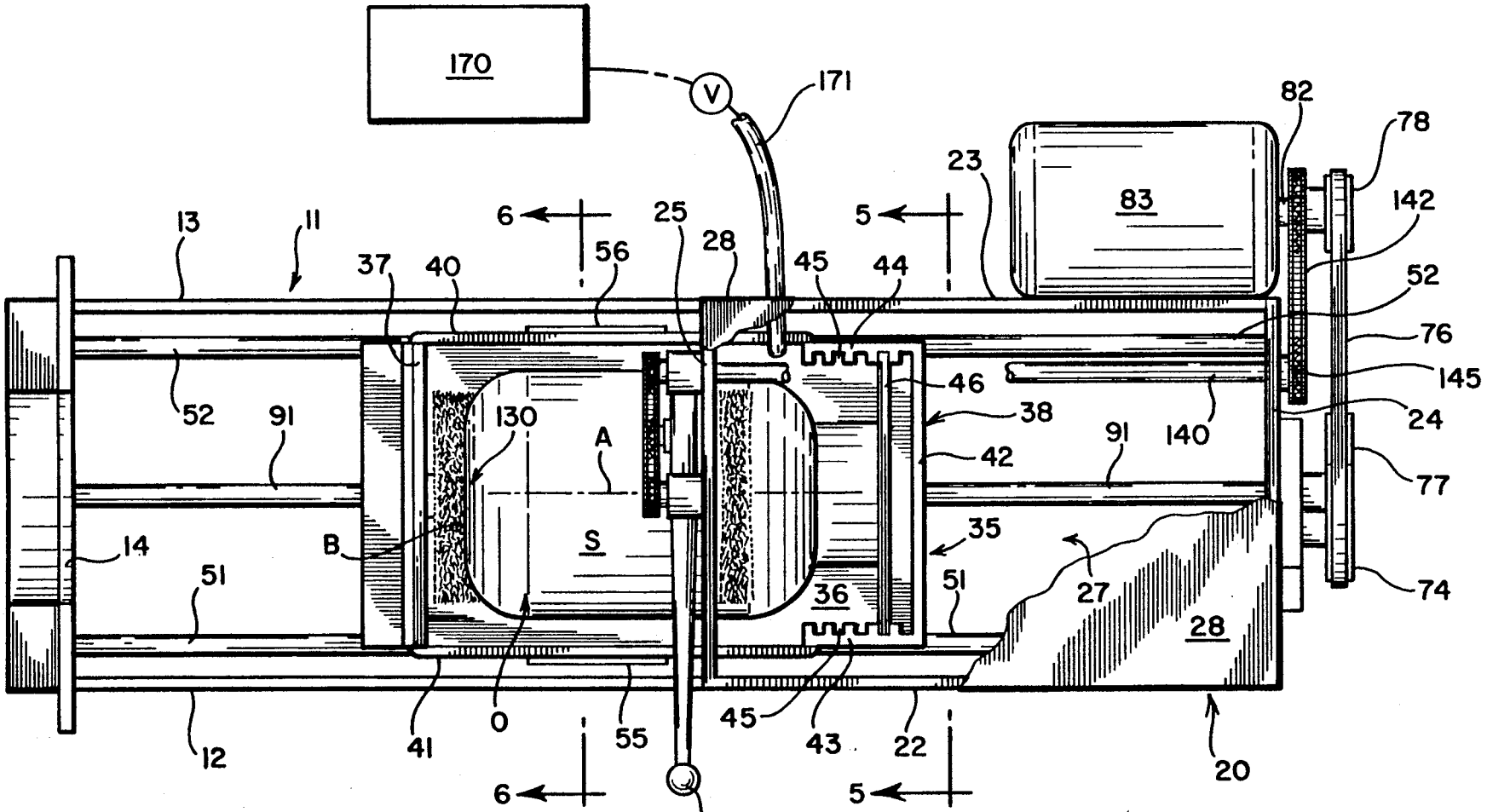
FIG. 2 is a top view of the cleaning machine of FIG. 1 with parts broken away for clarity, and illustrates a feed screw for the carriage, carriage support/guide rods, both brushes, a drive motor, and associated pulleys, a pulley belt, sprockets and drive chains for effecting reciprocal carriage movement and rotation of the brushes.

The cleaning machine 10 is designed specifically to clean objects O, such as a propane tank, but the cleaning machine 10 can be utilized to clean other generally cylindrical objects, such as drums, oxygen tanks, acetylene tanks or the like. Whatever might be the specific end use of the object O, the cleaning machine 10 is specifically constructed to clean an exterior peripheral/cylindrical body or surface S and an end wall or bottom B of the object o incident to the object O being totally reconditioned, including being subsequently painted. The object O also includes an axis A (FIGS. 2, 5 and 6 which is normally disposed parallel to the horizontal when the object O is being cleaned.

Figure 3:
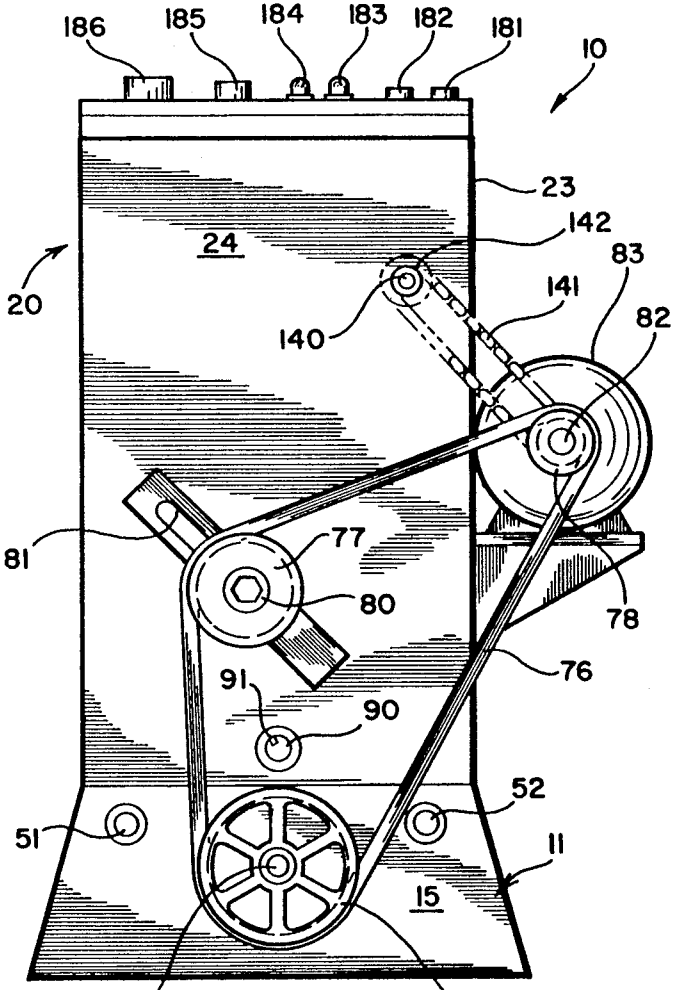
FIG. 3 is an end elevational view looking from right-to-left in FIG. 2, and illustrates the motor, a pulley belt and pulley for imparting rotation to a drive screw, and a chain for imparting rotation to a drive shaft for rotating the body cleaning brush.
Figure 5:
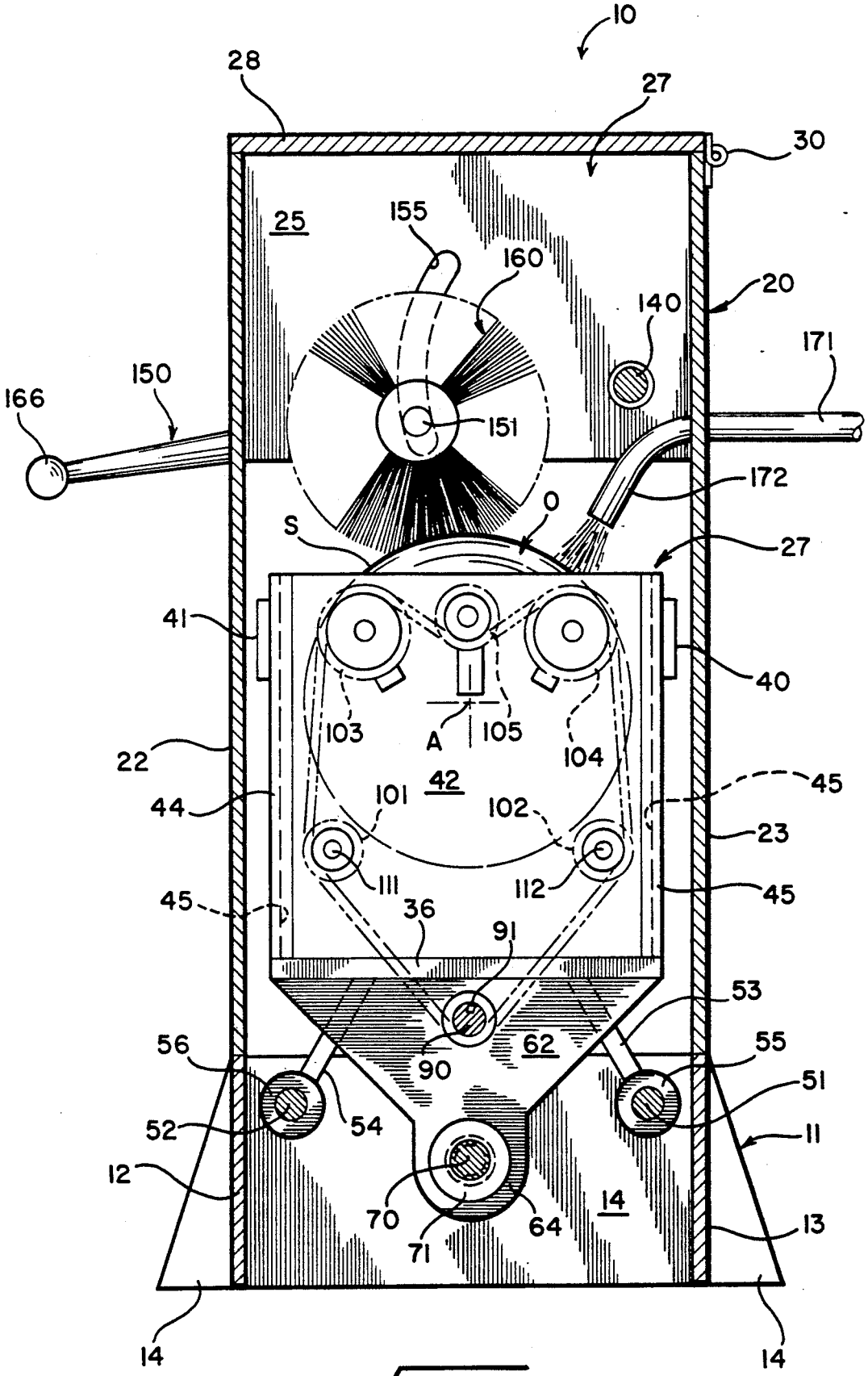
FIG. 5 is an enlarged cross-sectional view taken generally along line 5—5 of FIG. 2, and illustrates a drive connection from the drive shaft which imparts rotation to the bottom cleaning brush.

The cleaning machine 10 includes a base or frame 11 defined by relatively elongated generally parallel side walls 12, 13 (FIGS. 2 and 6) which are welded to opposite generally parallel end walls 14, 15. A housing 20 rests upon upper edges (unnumbered) of the side walls 12, 13 in the manner clearly illustrated in FIG. 5, and is defined by a pair of generally parallel housing side walls 22, 23 resting upon, welded to, and rising from the frame side walls 12, 13, as is illustrated in FIG. 5. The housing side walls 22, 23 are welded to a rear wall 24 (FIGS. 2 and 3) and to a parallel front wall 25 which defines therebelow an access opening 26 which opens into an interior chamber 27 normally closed by a top wall 28 pivotally secured by one or more hinges 30 to the housing side wall 23 (FIG. 5). The top wall 28 can be pivoted from the closed position shown in FIG. 5 to a full open position to permit access to the interior of the chamber 27.

A carriage 35 supports the object O with its axis A horizontal, as described heretofore, and is defined by a carriage bottom wall 36, a first carriage end wall 37, a second carriage end wall 38 of a generally U-shaped configuration, as viewed in top elevation, and carriage side walls 40, 41 which are in generally parallel relationship to each other. The second carriage end wall 38 is defined by a bight wall portion 42 and generally parallel side wall portions 43, 44 having opposing grooves 45 for selectively receiving therein opposite edges (unnumbered) of an adjusting end plate 46. When the adjusting end plate 46 is placed in the groove 45 closest to the bight wall portion 42, objects O of appreciable axial length can be seated within the carriage 35, but if shorter axial length objects O are to be seated in the carriage 35, the adjusting plate 46 need but be moved to those opposing notches 45 further from the bight wall portion 42 which will then allow the carriage 35 to accommodate such shorter objects O.

The carriage 35 is supported and guided for reciprocal sliding motion into and out of the chamber 27 through the access opening 26 by means of a pair of carriage support/guide rods 51, 52 which are generally parallel to each other (See FIG. 2) and opposite ends of which are appropriately rigidly connected to the base or frame end walls 14, 15. A pair of downwardly diverging legs 53, 54 are welded or integrally formed as part of the carriage bottom wall 36 and terminate in respective sleeves 55, 56 which telescopically receive the respective rods 51, 52. The sleeves 55, 56 are provided with conventional recirculating ball bearings or a sleeve bushing (not shown) to facilitate relative low friction sliding of the sleeves 55, 56 in opposite reciprocal directions along the respective rods 51, 52.

Figure 6:
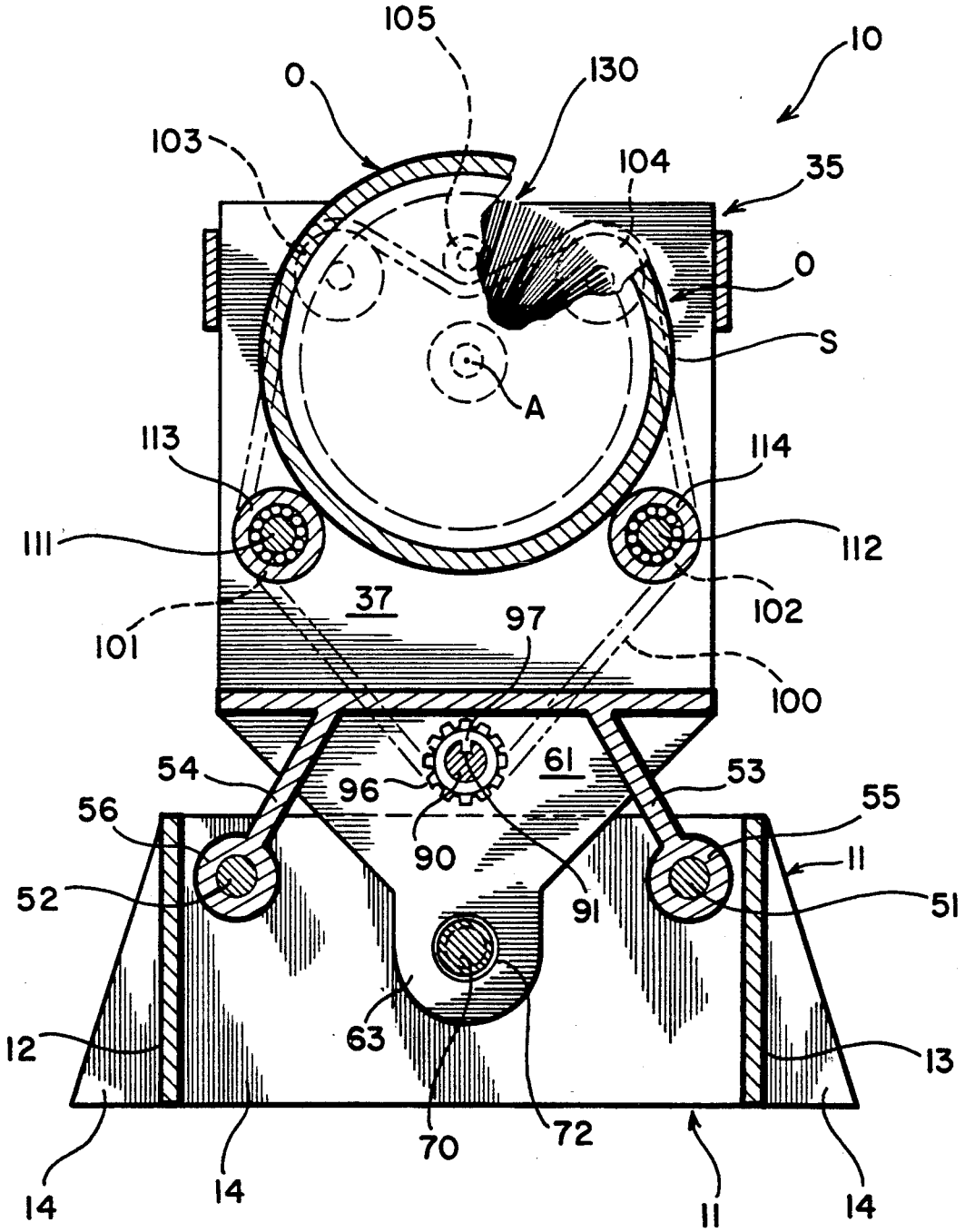
FIG. 6 is an enlarged cross-sectional view taken generally along line 6—6 of FIG. 2, and illustrates a drive connection between the carriage and the drive screw, a pair of carriage support and guiding rods, and the object/tank mounted for rotation on a pair of rotatable rollers.

The carriage 35 also includes two depending generally triangular plates 61, 62 which are integrally formed with or are welded to the underside of the carriage bottom wall 36 generally adjacent the respective carriage end walls 37, 38, respectively. The depending plates 61, 62 are parallel to each other and each includes a downwardly projecting portion 63, 64, respectively (FIGS. 6 and 5, respectively). Means in the form of a continuously threaded screw 70 is provided for imparting reciprocal motion to the carriage 35. The continuously threaded screw 70 is threaded, to an internally threaded bushing 71.(FIG. 5) fixed to the downwardly projecting or depending portion 64 of the plate 62. The screw 70 passes freely through an opening 72 in the downwardly projecting screw 70 adjacent the end plate 15 (FIG. 3) is suitably conventionally journalled for rotation in the end plate 15 and is connected to a pulley 74. The opposite end of the screw 70 is supported conventionally for free rotation in the end wall 14 (FIGS. 1 and 4) and has keyed thereto a chain sprocket 75. A pulley belt 76 (FIGS. 2 and 3) is entrained about the pulley 74 and about a tension idler pulley 77 and a drive pulley 78. The tension idler pulley 77 is rotated about a shaft 80 which is adjusted selectively along a slot 81 formed in the rear wall 24 of the housing 20 and serves to adjust the tension of the pulley belt 76 in a conventional manner. The drive pulley 78 is keyed to a drive shaft 82 of a reversible electric motor 83 which is suitably supported upon the exterior (unnumbered) of the housing side wall 23. As the shaft 82 is rotated in either direction by the reversible electric motor 83, the pulley belt 76 is similarly driven in selective opposite directions to similarly rotate the belt pulley 74 and the screw 70 keyed thereto. As the screw 70 is rotated within the threaded bushing 71 (FIG. 1), the carriage 35 is thereby moved into or out of the chamber 27 via the access opening 26. During such selective reciprocal motion the sleeves or guides 55, 56 slidingly and guidingly support the carriage 35 upon the rods 51, 52, again as is best evident from FIGS. 5 and 6 of the drawings.

The drive screw 70 also rotates a drive shaft 90 having a continuous keyway 91 which runs the entire length of the drive shaft 90. The drive shaft 90 is suitably conventionally mounted for rotation in journals carried by the end walls 14, 15, and a sprocket 92 is keyed to the drive shaft 90 adjacent the end wall 14. An idle sprocket 93 is keyed to a shaft 94 which is in turn journaled for rotation in the end wall 14. A drive chain 95 is entrained bout the sprockets 75, 92 and 93. Thus, upon rotation of the drive screw 70 in either of two directions, the sprocket 95 will in turn rotate the drive shaft 90.

The drive shaft 90 slidably receives a sprocket 96 (FIG. 6) having a key 97 which is housed in the keyway 91 but can slide longitudinally/axially relative thereto. The sprocket 96 is located immediately adjacent the plate 61 depending below the carriage end wall 37 on the inner side (unnumbered) thereof, namely, inside or to the right of the plate 61 as viewed in FIGS. 1 and 2. The sprocket 96 is confined in a yoke (not shown) or the like which allows the sprocket 96 to rotate when driven by the drive shaft 90 through its keyway 91 engaging the key 97 of the sprocket 96, but the sprocket 96 is axially fixed relative to the bottom wall 36 of the carriage 35 by a conventional Y-shaped yoke (not shown). Thus, as the carriage 36 reciprocates in either of its two directions, the rotation of the shaft 90 in either of these two directions will similarly rotate the sprocket 96 keyed thereto. The aforementioned yoke might be, for example, a pair of inverted generally Y-shaped members, the arms of which each embrace the shaft 90 while the sprocket 96 lies therebetween with the depending leg of each yoke being welded to the underside of the carriage bottom wall 36. Thus, as the carriage 35 moves in either direction, the sprocket 96 will be confined between the arms of the yoke and will move with the carriage 35 along the length of the shaft 90 in opposite directions, yet will rotate with the drive shaft 90 due to the drive connection between key 97 and keyway 91.

A drive chain 100 (FIGS. 5 and 6) is entrained about the sprocket 96 and drive sprockets 101 through 105. The sprockets 101, 102 are keyed to shafts 111, 112 which are parallel to each other and are journaled for rotation in a conventional manner in the carriage end walls 37, 38, specifically the bight wall portion 42 of the carriage end wall 38. A rubber roller or sleeve 113, 114 is fixed to the shafts 111, 112, respectively. Thus, as the sprockets 101, 102 are driven by the chain 100 through the sprocket 96, the rubber sleeves or rollers 113, 114 are selectively simultaneously rotated in the same direction and, thus, impart selective rotation to the object 0 resting thereupon, as is most evident in FIGS. 1 and 6 of the drawings.

Figure 4:
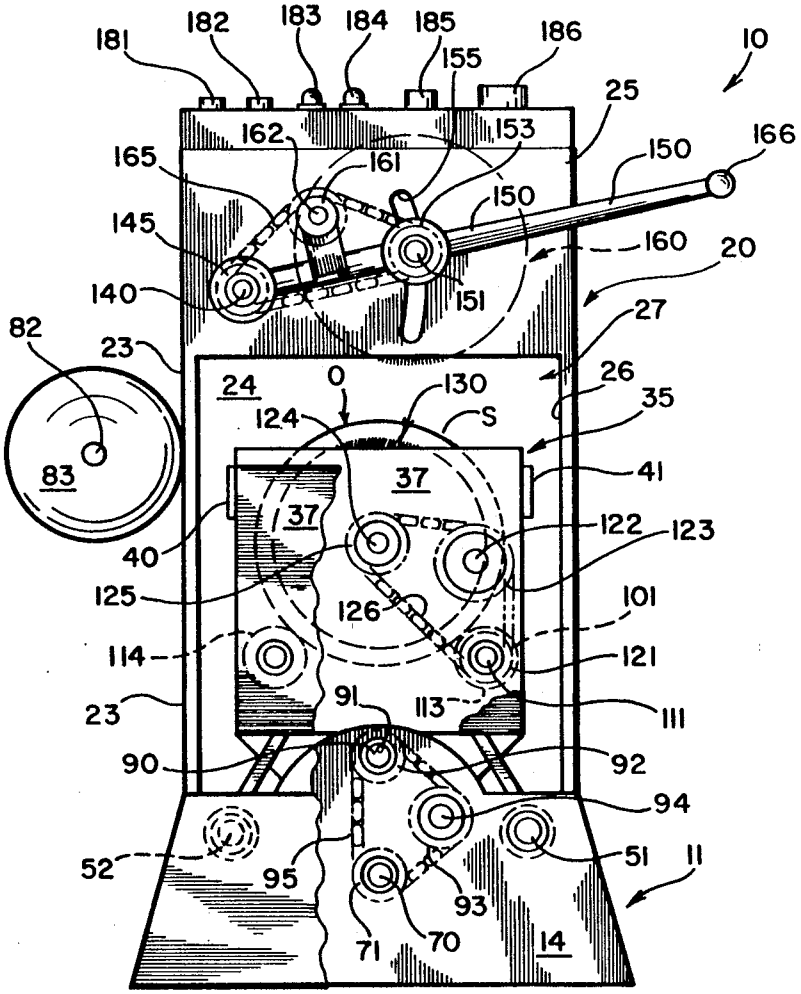
FIG. 4 is an end elevational view with parts broken away for clarity looking from left-to-right in FIG. 2, and illustrates the drive screw connected by a chain and sprocket to a drive shaft which in turns rotates both the object/tank rotating rollers and the bottom cleaning brush, and the body cleaning brush connected to a manual handle which carries a sprocket for rotating the main brush by the main drive shaft and an associated drive chain.

On the opposite side or outside of the carriage end wall 37 from the sprocket 101, a sprocket 121 is keyed to the shaft 111 (FIGS. 1 and 4). Shafts 122 and 124 are journaled for rotation in the carriage end wall 37, and each carries a respective sprocket 123, 125. A chain 126 is entrained about the sprockets 121, 123 and 125 Which causes rotation of the shaft 124 to which is keyed a brush 130 having an axis of rotation which is essentially horizontal. Thus, during the rotation of the object O, the brush 130 is rotated to clean the bottom B of the object O during reciprocal motion of the carriage 36 from its start or outermost position (FIG. 1) during its movement into the chamber 27 and its movement outwardly from the latter.

In addition to cleaning the bottom B of the object O by the brush 130, the reversible electric motor 83 (FIG. 3) also rotates another drive shaft 140 through a drive chain 141 and a sprocket 142 keyed or otherwise fixed to the drive shaft 140. The drive shaft 140 is suitable journaled for rotation in the rear wall 24 and the front wall 25, and has keyed thereto adjacent and outside the wall 25 a drive sprocket 145 (FIGS. 1 and 4). The shaft 140 passes through an enlarged opening (unnumbered) at one end of a manual handle 150 which at a medial portion thereof .rotatably journals a shaft 151 through a suitable bearing (not shown) within an enlarged portion 152 of the handle 150. The shaft 151 has a sprocket 153 keyed thereto. The shaft 151 passes through an arcuate slot 155 in the wall 25 and carries a brush 160. Another tension idle sprocket 161 is keyed to a shaft 162 which is conventionally mounted for vertical adjustment in a slot (unnumbered) of the wall 25. A drive chain 165 is entrained about the sprockets 145, 153 and 161 to impart rotation from the drive shaft 140 to the shaft 151 via the sprocket 153 which in turn rotates the brush 160. The handle 150 has a gripping portion or rounded end 166 which can be manually grasped to move the shaft 151 along the arc of the slot 155 to bring the brush 160 forcefully against the peripheral surface S of the object O to clean the same as the carriage 35 is moved into and out of the chamber 27 through the access opening 26.

From the foregoing, it is readily apparent that the single reversible electric motor 83 provides all of the power necessary to drive/rotate both brushes 130, 160, to also rotate the object O through the rollers 113, 114, and to traverse/reciprocate the carriage 35 into and out of the chamber 27. During such operation of the cleaning machine 10, water and detergent from a reservoir 170 (FIG. 2) can be provided through an appropriate valve v and a line 171 terminating in a nozzle 172 (FIG. 5) to direct a spray of the water/detergent against the object O during the cleaning thereof. Obviously, the valve v can be controlled through an appropriate servovalve (not shown) and a simple electric circuit which would cause flow of the water/detergent upon the energization of an appropriate circuit (not shown) by, for example, depressing a jog/move left button 181 or a jog/move right button 182 which would also impart appropriate energization/electricity to appropriately rotate the shaft 82 by energizing the motor 83. Preferably, a running light 183 will also be energized whenever either of the push buttons 181, 182 is actuated, and upon energization or deenergization of a main switch 185, a power light 184 will either be respectively "on" or "off." Preferably a panic button/palm switch 186 is provided which when depressed will immediately deenergize the entire system and bring all components to an immediate stop.

Although a preferred embodiment of the invention has been specifically illustrated and described herein, it is to be understood that minor variations may be made in the apparatus without departing from the spirit and scope of the invention, as defined the appended claims.

What is claimed is:

1. A machine for cleaning an object during rotation about an axis thereof comprising means for defining a chamber, a carriage, means for moving said carriage along a first path of travel in a first direction from a first position outside said chamber to a second position inside said chamber and along a second path of travel in a second direction from said second position to said first position, means for rotating the object at least during part of the time the carriage is within said chamber, first brush means for cleaning an axial end portion of the object during the rotation thereof, and second brush means for cleaning a peripheral outer surface portion of the object during the rotation thereof.

2. The cleaning machine as defined in claim 1 including means for rotating at least one of said first and second brush means.

3. The cleaning machine as defined in claim 1 including means for rotating both of said first and second brush means.

4. The cleaning machine as defined in claim 1 including means for rotating at least one of said first and second brush means about generally parallel axes.

5. The cleaning machine as defined in claim 1 including means for rotating both of said first and second brush means about generally parallel axes.

6. The cleaning machine as defined in claim 1 including means for rotating at least one of said first and second brush means about generally parallel axes which are parallel to the horizontal.

7. The cleaning machine as defined in claim 1 including means for rotating both of said first and second brush means about generally parallel axes which are parallel to the horizontal.

8. The cleaning machine as defined in claim 1 wherein said first and second directions are opposite parallel and reciprocal.

9. The cleaning machine as defined in claim 8 including a single power source, and means drivingly connecting said single power source to said moving means and said rotating means.

10. The cleaning machine as defined in claim 8 including mounting said second brush means for radial movement toward and away from the object when the carriage is within said chamber.

11. The cleaning machine as defined in claim 8 wherein said rotating means also rotates the object while outside said chamber at least during part of the time the carriage moves along the first path of travel in the first direction.

12. The cleaning machine as defined in claim 8 wherein said rotating means also rotates the object while outside said chamber at least during part of the time the carriage moves along the second path of travel in the second direction.

13. The cleaning machine as defined in claim 8 wherein said rotating means also rotates the object while outside said chamber at least during part of the time the carriage moves along the first path of travel in the first direction, and said rotating means also rotates the object while outside said chamber at least during part of the time the carriage moves along the second path of travel in the second direction.

14. The cleaning machine as defined in claim 8 including a single power source, means drivingly connecting said single power source to said moving means and rotating the same, and said drivingly connecting means includes a driven member carried by said carriage.

15. The cleaning machine as defined in claim 1 including a single power source, and means drivingly connecting said single power source to said moving means and said rotating means.

16. The cleaning machine as defined in claim 1 including mounting said second brush means for radial movement toward and away from the object when the carriage is within said chamber.

17. The cleaning machine as defined in claim 16 including means for selectively adjusting at least one dimension of said carriage to accommodate objects of different sizes.

18. The cleaning machine as defined in claim 17 including means for selectively adjusting at least one dimension of said carriage to accommodate objects of different sizes.

19. The cleaning machine as defined in claim 16 wherein said rotating means also rotates the object while outside said chamber at least during part of the time the carriage moves along the first path of travel in the first direction.

20. The cleaning machine as defined in claim 19 including means for selectively adjusting at least one dimension of said carriage to accommodate objects of different sizes.

21. The cleaning machine as defined in claim 16 wherein said rotating means also rotates the object while outside said chamber at least during part of the time the carriage moves along the second path of travel in the second direction.

22. The cleaning machine as defined in claim 21 including means for selectively adjusting at least one dimension of said carriage to accommodate objects of different sizes.

23. The cleaning machine as defined in claim 16 wherein said rotating means also rotates the object while outside said chamber at least during part of the time the carriage moves along the first path of travel in the first direction, and said rotating means also rotates the object while outside said chamber at least during part of the time the carriage moves along the second path of travel in the second direction.

24. The cleaning machine as defined in claim 1 including means for selectively adjusting at least one dimension of said carriage to accommodate objects of different sizes.

25. The cleaning machine as defined in claim 1 wherein said rotating means also rotates the object while outside said chamber at least during part of the time the carriage moves along the first path of travel in the first direction.

26. The cleaning machine as defined in claim 1 wherein said rotating means also rotates the object while outside said chamber at least during part of the time the carriage moves along the second path of travel in the second direction.

27. The cleaning machine as defined in claim 1 wherein said rotating means also rotates the object while outside said chamber at least during part of the time the carriage moves along the first path of travel in the first direction, and said rotating means also rotates the object while outside said chamber at least during part of the time the carriage moves along the path of travel in the second direction.

28. The cleaning machine as defined in claim 1 including a single power source, means drivingly connecting said single power source to said moving means and rotating the same, and said drivingly connecting means includes a driven member carried by said carriage.

29. A machine for cleaning an object during rotation about an axis thereof comprising a frame, a housing defining a chamber having an access opening, a carriage for housing an object adapted to be cleaned, said frame including guide means for guiding the movement of said carriage into and out of said chamber through said access opening along a first path of travel in a first direction from a first position outside said chamber to a second position inside said chamber and along a second path of travel in a second direction from said second position to said first position respectively, drive screw means for mounting said carriage in said first and second positions, a pair of rollers supporting the object in said carriage with an axis of the object parallel to the horizontal, first brush means carried by said carriage and rotatable about a horizontal axis for cleaning an axial end portion of the object during he rotation thereof, means for rotating at least one of said pair of rollers to rotate the object about its axis, second brush means carried by said housing and rotatable about a horizontal axis for cleaning a peripheral outer surface portion of the object during the rotation thereof, means for mounting said second brush means for generally radial movement generally in a plane normal to the first and second paths of travel, a single power source; and drive means drivingly connecting said single power source to said drive screw means, said first and second brush means, and said one roller rotation means.

* * * * *